US011186961B2

(12) United States Patent
Porter

(10) Patent No.: US 11,186,961 B2
(45) Date of Patent: Nov. 30, 2021

(54) EXTRUDED FIBER REINFORCED PVC GROOVED PILE

(71) Applicant: Mark A. Porter, Jacksonville, FL (US)

(72) Inventor: Mark A. Porter, Jacksonville, FL (US)

( * ) Notice: Subject to any disclaimer, the term of this patent is extended or adjusted under 35 U.S.C. 154(b) by 80 days.

(21) Appl. No.: 16/722,892

(22) Filed: Dec. 20, 2019

(65) Prior Publication Data

US 2020/0208369 A1 Jul. 2, 2020

Related U.S. Application Data

(60) Provisional application No. 62/785,749, filed on Dec. 28, 2018.

(51) Int. Cl.

| | |
|---|---|
| ***E02D 5/22*** | (2006.01) |
| ***E02D 5/24*** | (2006.01) |
| ***E02D 5/80*** | (2006.01) |
| *E02D 27/52* | (2006.01) |

(52) U.S. Cl.

CPC ..... *E02D 5/24* (2013.01); *E02D 5/226* (2013.01); *E02D 27/525* (2013.01); *E02D 2200/1685* (2013.01); *E02D 2250/0015* (2013.01); *E02D 2300/0007* (2013.01); *E02D 2300/0045* (2013.01); *E02D 2300/0053* (2013.01)

(58) Field of Classification Search

CPC ..... E02D 5/24; E02D 5/226; E02D 27/525; E02D 2250/0015; E02D 2300/0007; E02D 2300/0045; E02D 2300/0053; E04C 3/36

See application file for complete search history.

(56) References Cited

U.S. PATENT DOCUMENTS

| | | | | |
|---|---|---|---|---|
| 3,941,157 A | | 3/1976 | Barnett | |
| 3,957,250 A | * | 5/1976 | Murphy | E04H 17/06 256/19 |
| 4,110,989 A | | 9/1978 | Selkirk | |
| 4,183,777 A | | 1/1980 | Summers et al. | |
| 4,697,649 A | * | 10/1987 | Kinnan | E21B 7/20 175/162 |
| 5,051,285 A | | 9/1991 | Borzakian | |

(Continued)

FOREIGN PATENT DOCUMENTS

| | | | |
|---|---|---|---|
| CN | 203783246 U | * | 8/2014 |
| CN | 209082485 U | * | 7/2019 |

(Continued)

OTHER PUBLICATIONS

E-Glass Chopped Strand Fibers, Lauscha Fiber International, Jun. 2014, https://www.unifrax.com/wp-content/uploads/2018/08/U-807-EN.pdf (Year: 2014).*

*Primary Examiner* — Benjamin F Fiorello
*Assistant Examiner* — Stacy N Lawson
(74) *Attorney, Agent, or Firm* — Mark Young, PA

(57) ABSTRACT

A pile is comprised of a pipe, i.e., a tube or hollow cylinder of annular cross-section, with a coextensive internal reinforcement comprised of a plurality of intersecting walls forming a plurality of vertices. Each vertex intersects the pipe. Adjacent intersections are evenly spaced around the annular cross-section. The pile is comprised of a blend of PVC and 20 to 50% (pbw) chopped strand glass fibers. A groove is cut into the pile adjacent to an end for frictional retention in a sea bed.

20 Claims, 9 Drawing Sheets

(56) References Cited

U.S. PATENT DOCUMENTS

| | | | | |
|---|---|---|---|---|
| 5,706,620 | A * | 1/1998 | De Zen | H02G 3/286 52/220.2 |
| 6,123,485 | A * | 9/2000 | Mirmiran | E02D 31/02 405/232 |
| 6,405,974 | B1 | 6/2002 | Herrington | |
| 6,675,919 | B2 * | 1/2004 | Mosing | E21B 7/20 166/358 |
| 6,955,780 | B2 | 10/2005 | Herrington | |
| 8,266,856 | B2 | 9/2012 | Carlson et al. | |
| 2002/0194795 | A1 | 12/2002 | Spite | |
| 2004/0224141 | A1 | 11/2004 | Seiling | |
| 2005/0242456 | A1 | 11/2005 | Seilin et al. | |
| 2007/0172315 | A1 * | 7/2007 | Barrett | E02D 3/12 405/259.5 |
| 2009/0241447 | A1 * | 10/2009 | Vollan | E02D 27/00 52/294 |
| 2013/0014453 | A1 * | 1/2013 | Hargrave | E02D 5/60 52/101 |
| 2015/0040509 | A1 * | 2/2015 | Peltola | B29C 48/21 52/582.1 |
| 2016/0040384 | A1 * | 2/2016 | Wagner | E02D 5/60 405/235 |

FOREIGN PATENT DOCUMENTS

| | | | | |
|---|---|---|---|---|
| JP | 58173219 | A * | 10/1983 | E02D 5/24 |
| KR | 20080039020 | A * | 5/2008 | |

* cited by examiner

EXTRUDED FIBER REINFORCED PVC GROOVED PILE

RELATED APPLICATION

This application is a nonprovisional and claims the benefit of priority of U.S. provisional application 62/785,749 filed Dec. 28, 2018, the entire contents of which are incorporated herein by this reference and made a part hereof.

FIELD OF THE INVENTION

This invention relates generally to structures for construction, and, more particularly, to a cost-effective, extruded, internally reinforced pile that (a) is impervious or highly resistant to marine life, (b) does not leach toxic chemicals into water, (c) is relatively easy to position and (d) is capable of being cut and drilled using conventional hand tools.

BACKGROUND

Wood piles have been used for many years to support piers, wharves and the like. In residential marine structures, wood piles have been favored over concrete piles for lower cost and ease of transportation and installation. A buoyant wood pile can be floated to an installation location, placed without use of heavy cranes that are required to move and install concrete piles, and installed and finished with use of conventional drills, screws and saws.

Unfortunately, wood piles are subject to many hazards that eventually necessitate replacement. One major source of damage is marine life. Parasites and microorganisms are particularly troublesome. By way of example, marine organisms such as limnoria and shipworms are prevalent in salt and brackish waters and commonly infest submerged wooded structures seriously sapping the strength and life of the structures. Limnoria is a genus of crustaceans commonly known as gribbles. When they attack a pile, their tunnels almost touch, so the thin walls between them are quickly worn away by wave action, leaving a new surface of wood ready for reinfestation. Shipworms will attack any untreated wood, with the attack destroying more than one-half of the volume of a pile without any evidence of injury being apparent on the pile's surface.

In the past, wood preservatives, i.e., chemical pesticides, were freely applied to wood to protect it from decay brought about by fungi and organism attack. The most effective treatments, forced preservative solutions deeply into the wood under high pressure. Creosote, pentachlorophenol, and inorganic arsenicals such as chromated copper arsenate (CCA) were the three most widely used wood preservative compounds. Scientists, environmentalists and regulators eventually expressed concern that when preserved wood was used for in-water construction such as piles, break walls, abutments, or other submerged or partially submerged structures, the toxic preservatives leached from the wood, contaminating water, harming marine life and posing health risks. Today, the use of such preservatives in marine construction is regulated by federal, state and local authorities, generally restricting or prohibiting their use.

What is needed is a cost-effective pile that (a) is impervious or highly resistant to marine life, (b) does not contain toxic chemicals that may leach into water, (c) is relatively easy to lift and (d) is capable of being cut and drilled using conventional hand tools.

The invention is directed to overcoming one or more of the problems and solving one or more of the needs as set forth above.

SUMMARY OF THE INVENTION

To solve one or more of the problems set forth above, in an exemplary implementation of the invention, a pile is provided. A pile according to principles of the invention is comprised of a pipe, i.e., a tube or hollow cylinder of annular cross-section, with a coextensive internal reinforcement comprised of a plurality of intersecting walls, such as, by way of example, a plurality of intersecting walls forming a hexagram cross-section. Other polygonal and nonpolygonal shapes of internal reinforcing walls are possible, within the scope of the invention.

The pile is comprised of coextruded polyvinyl chloride (PVC) with glass fibers. The PVC, glass fibers and additives are mixed together and extruded as the inner layer. An outer layer, i.e., a cap stock, that enhances impact resistance, provides protection from ultraviolet radiation, and reflects infrared radiation is also provided.

Grooves are formed in the bottom portion of the outer (and/or inner) surface of the pile. Such grooves are cut into the pile after extrusion. A machine includes a cutting motor, a rotating cutter wheel and an actuator that moves the cutting motor and rotating cutter wheel towards the surface of the pipe to be grooved. The actuator and cutting motor are mounted to a sleeve that revolves around the extruded pipe. A slip ring supplies electric power to the actuator and cutting motor. A drive motor drives the sleeve.

The grooves may comprise a continuous thread-like spiral groove, or separate spaced apart (e.g., parallel) grooves. The grooves provide a rough surface that resists uplift when the bottom portion of the pile is embedded in the sea bed. Without the grooves, uplift could pose a serious problem for a smooth surfaced constant diameter pile. Optionally, for further frictional resistance to uplift, a similar machine with a wire wheel instead of a cutter may be used to roughen the surface of the grooved portion of the pipe. Alternatively, the grooves and roughening may be formed manually using hand tools.

An exemplary integrally formed extruded pile includes an outer pipe structure having an outer diameter of at least eight inches (e.g., 12 inches), and having an annular cross-section shape defining an interior space, and having a length from a first end to an opposite second end. A plurality of intersecting walls is formed within the interior space. The intersecting walls are coextensive with the outer pipe and form a plurality of evenly spaced apart vertices that intersect the outer pipe. A groove is cut in the outer pipe adjacent to the first end. The extruded pile is comprised of a blend of polyvinylchloride and chopped strand glass fibers having diameters of 5 to 18 μm and strand lengths of 0.125 to 0.50 inches. The glass fibers comprise 20 to 50% by weight of the blend. The extruded pile also includes an outer layer formed by coextrusion. The outer layer comprising an infrared includes a radiation inhibitor, such as titanium dioxide or zinc dioxide. The outer layer may further include an impact modifier. In one embodiment, the groove is a continuous spiral groove extending from the first end to a position along the length, the position being between a midpoint of the length and the first end.

Each vertex of the plurality of spaced apart vertices is equally spaced apart from another vertex of the plurality of spaced apart vertices. The plurality of spaced apart vertices comprising at least 5 spaced apart vertices.

In one embodiment, the intersecting walls form a hexagram cross-section shape. The hexagram cross section shape includes six vertices. Each vertex of the six vertices intersects the outer pipe and is evenly spaced apart from adjacent vertices. Each vertex is also directly opposite another vertex.

The outer pipe may have a wall thickness of 0.25 to 0.50 inches. Each wall of the plurality of intersecting walls within the interior space may have a wall thickness of 0.125 to 0.25 inches.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An exemplary pile according to principles of the invention is comprised of a pipe, i.e., a tube or hollow cylinder of annular cross-section, with a coextensive internal reinforcement comprised of a plurality of intersecting walls. In the example provided in FIG. 1, the intersecting walls forma hexagram cross-section. The hexagram includes 6 vertices. Each vertex intersects the pipe. Adjacent intersections are evenly spaced around the annular cross-section.

Figure 1:
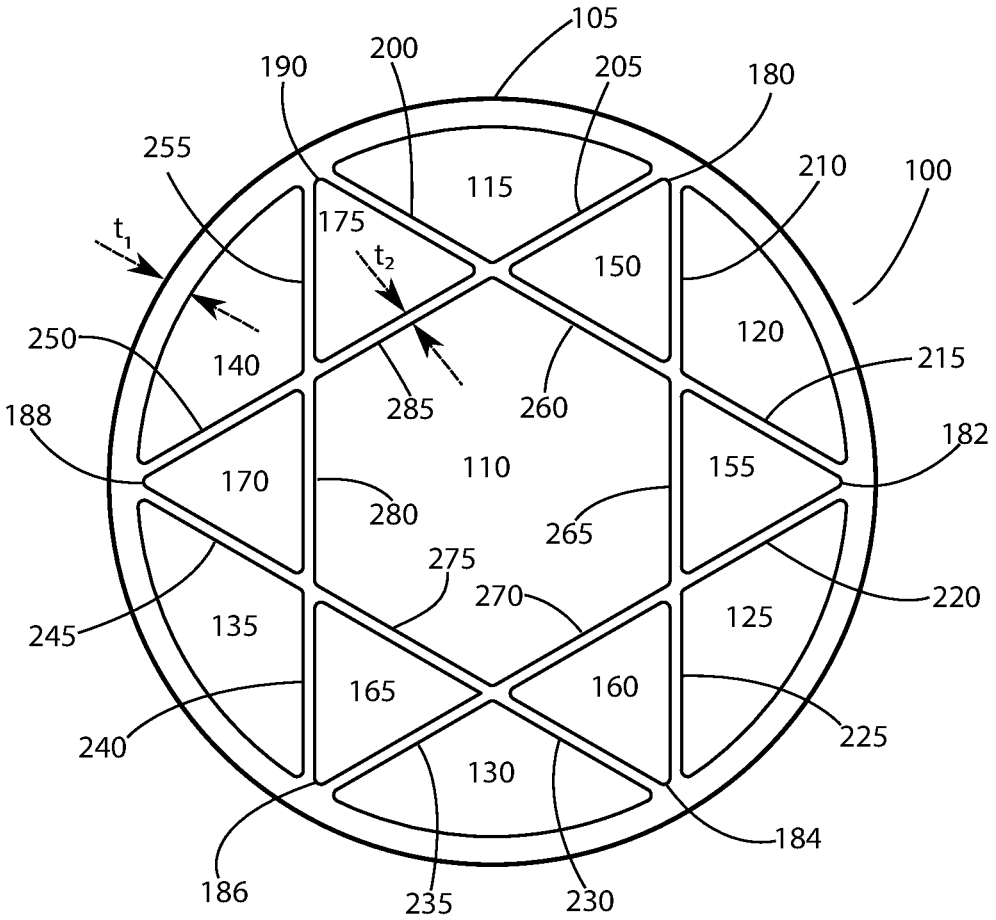
FIG. 1 is a plan view of an exemplary pile with a cast core according to principles of the invention.
Figure 3:
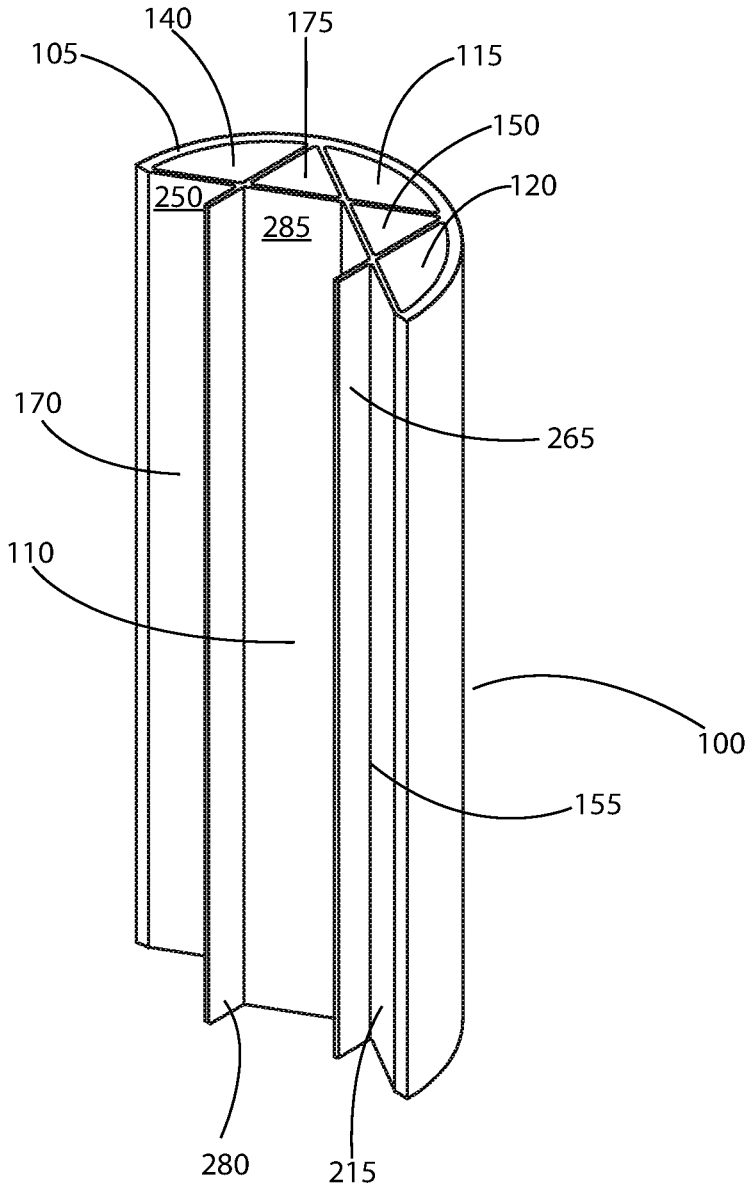
FIG. 3 is a perspective section view of an exemplary pile according to principles of the invention.

With reference to FIG. 1 and the corresponding section view of FIG. 3, the outermost portion of the pile 100 is a hollow pipe of annular cross section 105. As discussed below, the pipe may include a plurality of co-extruded layers.

The exemplary hexagram is a six-pointed geometric star figure, more particularly, a compound figure of two overlapping equilateral triangles with their intersection forming a regular hexagon and each vertex of one equilateral triangle being directly opposite a vertex of the other equilateral triangle. One equilateral triangle is formed of a first side comprised of walls 255, 280, 240, and second side comprised of walls 200, 260, 215, and a third side comprised of walls 220, 270, 235; and a first vertex 190 between the first and second sides; a second vertex 182 between the second and third sides; and a third vertex 186 between the first and third sides. The other equilateral triangle is formed of a first side comprised of walls 250, 285, 205; and second side comprised of walls 210, 265, 225; and a third side comprised of walls 230, 275, 245; and a first vertex 180 between the first and second sides; a second vertex 184 between the second and third sides; and a third vertex 188 between the first and third sides.

The hexagon 110 occupies the center of the cross section. Walls 260, 265, 270, 275 and 280 define the hexagram. Each such wall also is a wall of a smaller triangle, as discussed below.

All three sides of each equilateral triangle are equal. Each vertex is a point where two lines of the equilateral triangle meet. Internal angles at each vertex are congruent to each other and are each 60°. The cross-section of the pipe is an annulus 105 that passes through all three vertices of each equilateral triangle. The inner radius, r, of the annulus is:

$$r = \frac{a}{\sqrt{(3)}}$$

where α is the length of a side of the equilateral triangle. For example, the length of one side, is the sum of the lengths of walls 255, 280 and 240. All three sides of each equilateral triangle are equal in length.

The overlapping equilateral triangles form 6 smaller equilateral triangles. One such triangle is defined by walls 200, 255, 285, defining a triangular space 175 therebetween. Another such triangle is defined by walls 205, 210, 260, defining a triangular space 150 therebetween. Another such triangle is defined by walls 215, 220, 265, defining a triangular space 155 therebetween. Another such triangle is defined by walls 225, 230, 270, defining a triangular space 160 therebetween. Another such triangle is defined by walls 235, 240, 275, defining a triangular space 165 therebetween. Another such triangle is defined by walls 245, 250, 280, defining a triangular space 170 therebetween.

Each side of each equilateral triangle is a chord, i.e., a straight line with endpoints that lie on the annulus. Two pie slice sections and one of the smaller triangles between the two pie slice sections are between the chord and the perimeter of the annulus 105. For example, chord 255, 280, 240 and the arc of the annulus 105 extending from vertex 186 to vertex 190 enclose triangle 170 between pie sections 135 and 140. Chord 250, 285, 205 and the arc of the annulus 105 extending from vertex 188 to vertex 180 enclose triangle 175 between pie sections 140 and 115. Chord 200, 260, 215 and the arc of the annulus 105 extending from vertex 190 to vertex 182 enclose triangle 150 between pie sections 115 and 120. Chord 210, 265, 225 and the arc of the annulus 105 extending from vertex 180 to vertex 184 enclose triangle 155 between pie sections 120 and 125. Chord 220, 270, 235 and the arc of the annulus 105 extending from vertex 182 to vertex 186 enclose triangle 160 between pie sections 125 and 130. Chord 230, 275, 245 and the arc of the annulus 105 extending from vertex 184 to vertex 188 enclose triangle 165 between pie sections 130 and 135.

Each of the smaller equilateral triangles share a side with the hexagon 110 formed by the two overlapping equilateral triangles, as discussed above. Wall 260 is shared by the hexagon 110 and triangle 150. Wall 265 is shared by the hexagon 110 and triangle 155. Wall 270 is shared by the hexagon 110 and triangle 160. Wall 275 is shared by the hexagon 110 and triangle 165. Wall 280 is shared by the hexagon 110 and triangle 170. Wall 285 is shared by the hexagon 110 and triangle 175.

Each vertex 180, 182, 184, 186, 188 and 190 of each equilateral triangle intersects the annular cross section pipe 105. The intersections are evenly spaced about the annulus 105. Thus, the angle formed by radii extending from the center of the annulus to each adjacent vertex is 60°. For example, the angle between radii extending from the center to vertex 180 and from the center to vertex 182 is 60°.

The arclengths between adjacent vertices are equal. The arc extending from one vertex to another adjacent vertex subtends an angle of 60° with the annulus center. Each such arclength is:

$$L=\theta\cdot r$$

where θ is the subtending angle in radians and r is the radius. A subtending angle of 60° is equal to 1.0472 radians. Thus, arclength of each arc extending between each pair of adjacent vertices is 1.0472·r. For example, the arc extending from vertex 180 to vertex 182 is the product of 1.0472 and the radius, r, of the annulus 105.

Wall thicknesses may vary. In one nonlimiting exemplary embodiment, the thickness, $t_1$, of the circular wall 105 is 0.25 to 0.50 inches and the thickness, $t_2$, of each wall of the hexagram is 0.125 to 0.25 inches. An outer layer (i.e., cap stock) providing an additional thickness of about 0.01 to 0.10 inches may be co-extruded on the pipe. In a particular nonlimiting exemplary embodiment, the thickness, $t_1$, of the circular wall 105 is about 0.480 inches, including a coextruded protective outer layer (i.e., a co-extruded cap), and the thickness, $t_2$, of each wall of the hexagram is about 0.180 inches. More specifically, the circular wall may be comprised of a base portion having a thickness of 0.460 inches and a coextruded cap having a thickness of 0.020 to 0.090 inches (e.g., 0.060 inches).

Figure 2:
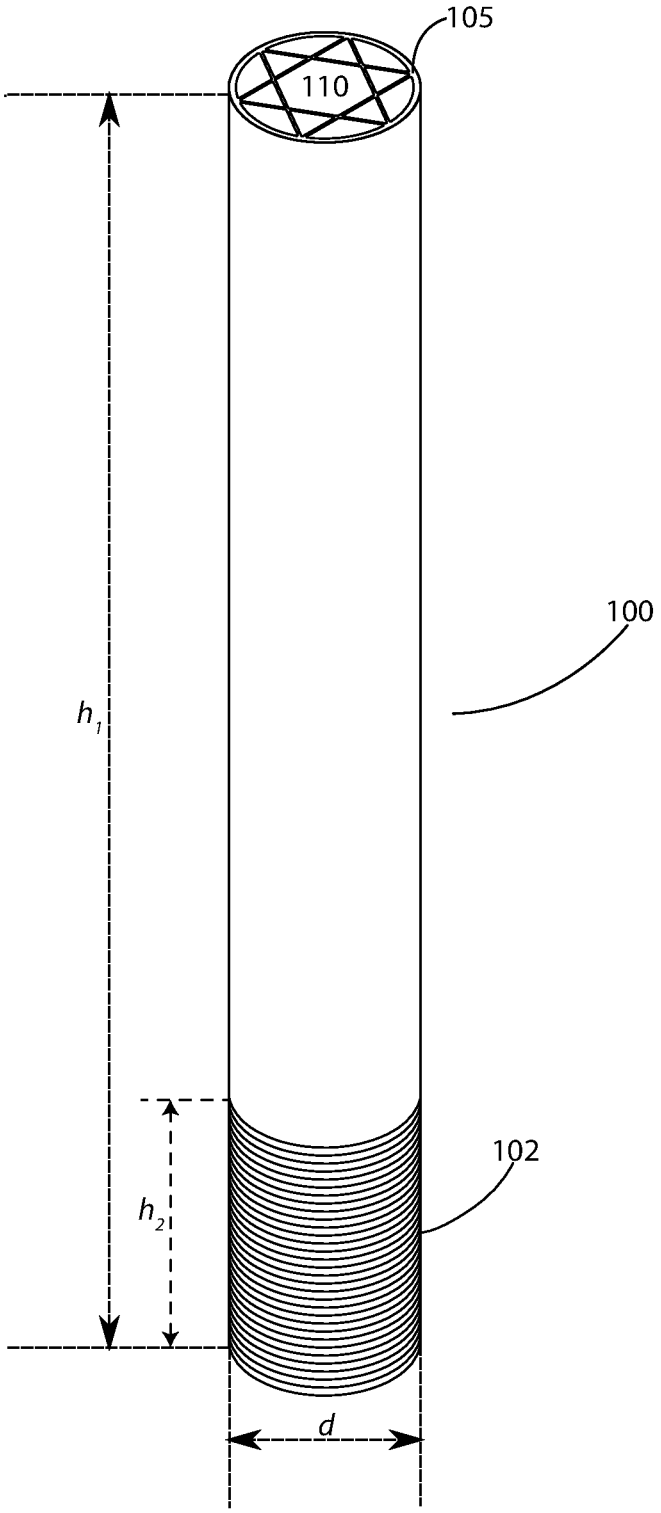
FIG. 2 is a perspective view of an exemplary pile according to principles of the invention.
Figure 4:
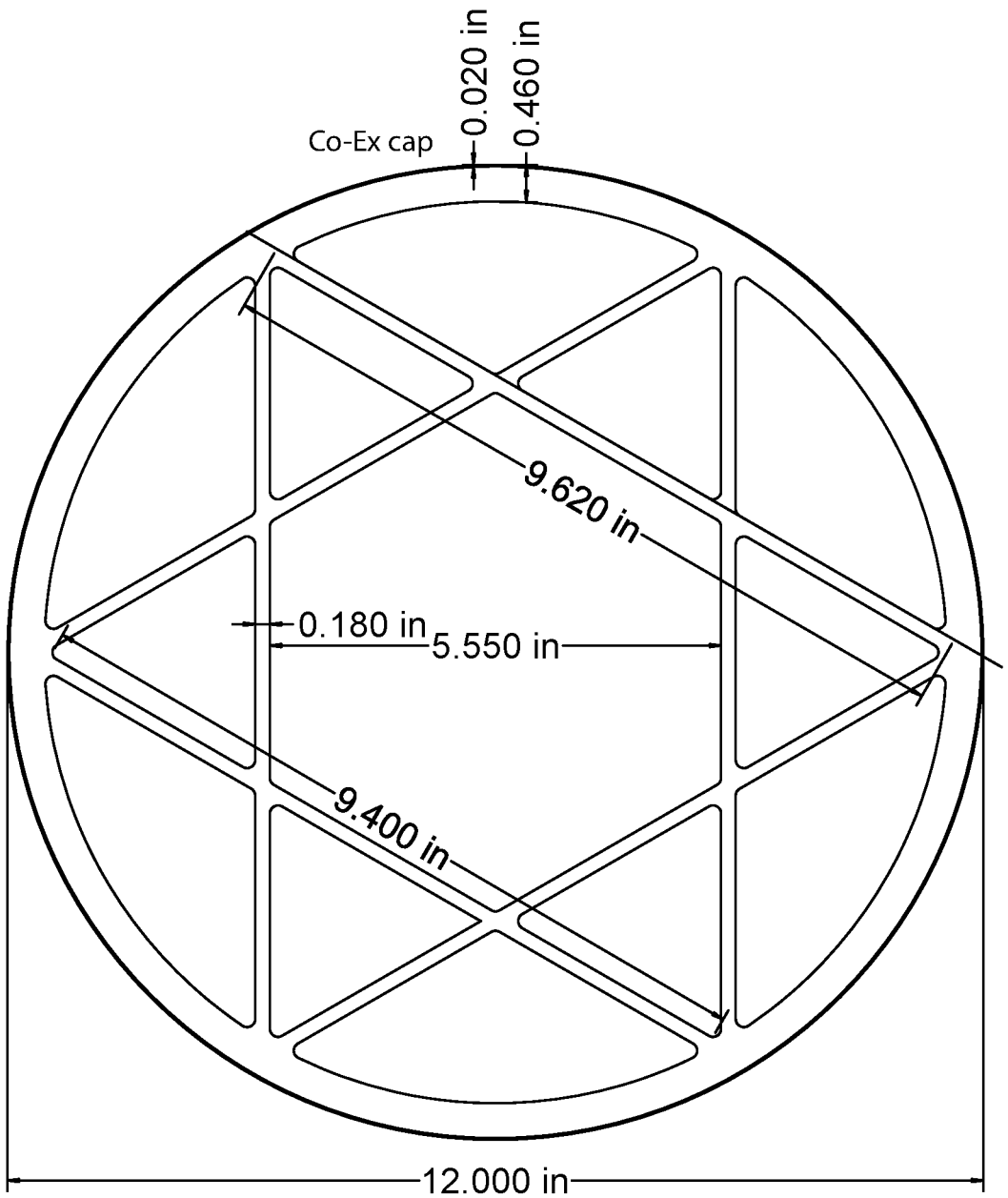
FIG. 4 is a dimensioned plan view of an exemplary pile according to principles of the invention.

With reference to FIG. 2, outer diameter, d, of the circular portion 105 may vary. In one nonlimiting exemplary embodiment, the outer diameter, d, is about 8 to 16 inches. In a particular nonlimiting exemplary embodiment, the outer diameter, d, is about 12 inches. Nonlimiting examples of dimensions are provided in FIG. 4. As used herein, about means±10%.

A pile 100 according to principles of the invention may be sized to replace a conventional pile. Thus, a pile 100 according to principles of the invention, may have the same length, $h_1$, as any conventional wood, concrete or metal pile. Additionally, a pile 100 according to principles of the invention may be cut to a desired length using conventional cutting tools for a wood pile.

Furthermore, a pile 100 according to principles of the invention has a grooved section 102 at one end of the pile, extending from about the end of the pile to a distance $h_2$. The distance $h_2$ is less than half, and preferably no more than a third or quarter, of the total length, $h_1$. All or a substantial portion of the portion of the pile embedded in the sea bed preferably includes grooves. The grooves resist uplift.

Uplift refers to an upward (i.e., vertical) vector component of a force acting on a pile. Such a force may, for example, be due to buoyancy, seismic activity, soil dynamics in the seabed, fluid forces from wave and/or wind action, and interaction with boats. Without adequate resistance to uplift, an end of a pile may become dislodged from the sea bed, upon which the pile will cease to provide structural support. Without grooves or other roughening at the embedded end of the pile, the pile, with its smooth outer and inner surfaces and constant diameter, would provide minimal resistance to uplift. With an embedded grooved end, the pile resists uplift as well as, or better than, conventional wood piles.

A jetting wand may be extended through the central hexagon 110, from one end of the pile to the opposite end of the pile 100. A jetting wand is used for installation of the pile 100 by water jetting. Such jetting utilizes a pressurized flow of water to disturb soils beneath the pile 100. Jetting liquefies the disturbed soil, reducing the friction and interlocking between adjacent soil particles. This greatly decreases the bearing capacity of the soil below the pile 100, allowing the pile 100 to descend with minimal net downward force.

While conventional pile jetting entails use of a wand to direct a jet of water around the periphery of the bottom of a pile, a pile 100 according to principles of the invention directs the jet directly beneath the bottom of the pile 100. This results in more effective jetting installation with reduced disturbance to soil surrounding the pile 100. The surrounding soil that is left substantially undisturbed provides superior support to the descended portion of pile 100. While not preferred, a compressed air jet may be used instead of a pressurized water jet with the same or similar end result.

In an exemplary embodiment, the pile 100 is comprised of an extruded rigid polyvinylchloride (PVC) with glass fiber reinforcement. PVC is advantageous because it is relatively inexpensive, resistant to environmental degradation (as well as to chemicals and alkalies), exhibits high hardness for a plastic and outstanding tensile strength for a plastic. PVC is also widely available, commonly used, easily recyclable and readily available as a recycled material.

The PVC plastic material without fiber reinforcement is the matrix. The extent that strength and rigidity are enhanced in the fiber-reinforced plastic depends on the mechanical properties of both the fiber and matrix, their volume relative to one another, and the fiber length and orientation within the matrix.

PVC has a very high viscosity in the processing range. The high viscosity complicates processing with added reinforcing fibers. To improve processing, additives are introduced into the mix.

The PVC matrix may be a commercially available, free flowing, granular powder. Additives, such as one or more non phthalate plasticizers, such as, but not limited to, dioctyl terephthalate (DOTP), may be used to decrease the viscosity of the mix and to improve flexibility and durability.

Another additive, a lubricant may be used to reduce friction between the processing machinery and the plastic materials, between the molecules of the plastic materials and between the molecules of the plastic materials and the fiber reinforcements. The lower the friction, the better the processing properties of the underlying plastic. ORC-A (calcium acetylacetante) is one nonlimiting example of a lubricant.

Another additive, a heat stabilizer, may be used to greatly increase the heat stability of PVC, such as scavenging of HCl molecules released during processing. Without a heat stabilizer, when PVC is exposed to heat (>100° C.), HCl is eliminated from the polymer backbone, which triggers a further autocatalytic degradation process, causing rapid discoloration and embrittlement of the PVC. A nonlimiting example of a heat stabilizer is barium-zinc, calcium-zinc or aluminum magnesium carbonate hydroxide (hydrate) additive.

Another additive, an impact modifier, may be used to improve durability and toughness. In addition to the impact performance, a number of other characteristics such as tensile properties, weatherability, processability, flammability, and heat distortion can be improved by adding an impact modifier. A nonlimiting example of an impact modifier is precipitated calcium carbonate (PCC).

As a reinforcement, chopped strand fibers, i.e., glass fibers, are added. The fibers generally contain oxides of silicon, calcium, aluminum, magnesium and/or boron. By way of example and not limitation, the fibers may comprise E-glass, which is alumino-borosilicate glass with less than 1% (by weight) alkali oxides. The fibers are small diameter (e.g., about 5 to 18 μm) strands, each having a short length (e.g., about 0.125 to 0.50 inch).

The glass fibers comprise a substantial portion of the mix to be extruded. The glass fibers comprise approximately 20-50% 9 (by weight) of the PVC mix. In a particular exemplary embodiment, the glass fibers comprise 30% (by weight) of the PVC mix.

The ingredients for the mix are introduced into a vessel, before extruding. Then they are mixed. Any mixing apparatus suitable for blending solids may be used. Before extrusion, the mix should be substantially homogeneous. Thus, two samples of equal volumes from different parts of the mix should exhibit the same or closely similar masses, and the same or closely similar concentration of each ingredient (e.g., PVC, each additive and reinforcing fibers).

In an exemplary implementation, to produce a pile 100 according to principles of the invention, a PVC pipe with a coextensive internal reinforcing structure (e.g., the hexagram structure described above) is extruded. A protective outer layer is coextruded with the pipe. The pile may be cut to a desired length.

Unplasticized PVC (PVC-U) is hard and brittle. An important characteristic of PVC is the glass transition temperature, $T_g$, which describes the significant change of a hard and stiff material behavior to a tough and soft one. This temperature is not a sharp point but a temperature range. For PVC-U the glass transition is at about 80° C., 176° F. However, by adding plasticizers, the stiffness and the glass transition temperature can be reduced significantly.

PVC pipe may experience a substantial reduction in rigidity if stored outdoors in a hot climate. Infrared radiation from the sun will heat the pipe. If the pipe is stored horizontally, heat collects within the pipe. Over time, the temperature of the pipe may approach or even exceed the glass transition temperature, especially if the pipe includes plasticizer and is stored on blacktop.

The outer layer may incorporate PVC, colorants, one or more IR and UV inhibitors, and impact modifiers. Titanium dioxide, zinc dioxide and other infrared reflecting pigments are highly effective for inhibiting degradation from infrared radiation. The outer layer, which is devoid of glass fibers, prevents spalling from the inner layer containing glass fibers. The outer layer may also include a relatively high concentration of impact modifiers to reduce brittleness, while shielding the inner layer from degradation that may otherwise increase its brittleness.

If the ends of the pile are capped, the pile will be buoyant. If so, it can be floated into position. Caps may be removed before installation.

The pile is relatively lightweight. It can be maneuvered with the same equipment used for wood piles. It can be drilled using ordinary drill bits suitable for drilling wood. It can be cut using ordinary saw blades suitable for cutting wood. It will not leach toxic chemicals. It will not be susceptible to attack by wood-destroying microorganisms. It possesses adequate structural properties (e.g., compressive strength and modulus of elasticity) that are sufficient for use as a structural pile. Depending upon the particular formulation, the structural properties will at least equal or exceed those for conventional wood piles. Furthermore, it allows efficient installation by water jetting through the central cavities.

Advantageously, a pile according to principles of the invention is impervious or highly resistant to marine life, does not contain toxic chemicals that may leach into water, is buoyant and can be floated into position, is relatively easy to lift using the same equipment used to lift wooden piles, and is capable of being cut, nailed and screwed using conventional hand tools and hardware for wood construction. Additionally, a pile according to principles of the invention is readily configured for water jetting.

Figure 5:
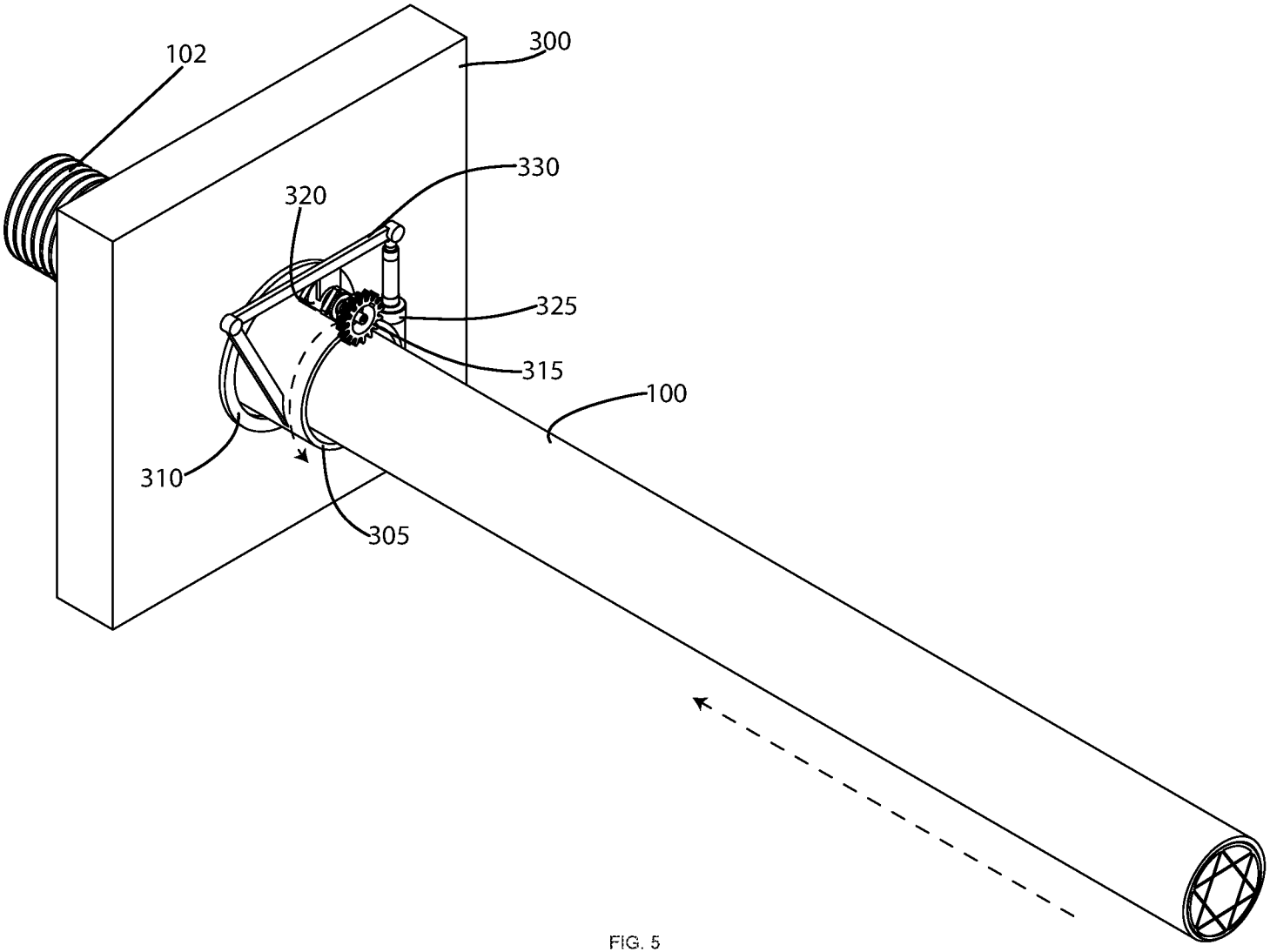
FIG. 5 is a first schematic view of an exemplary pile proceeding through a grooving machine, according to principles of the invention.
Figure 6:
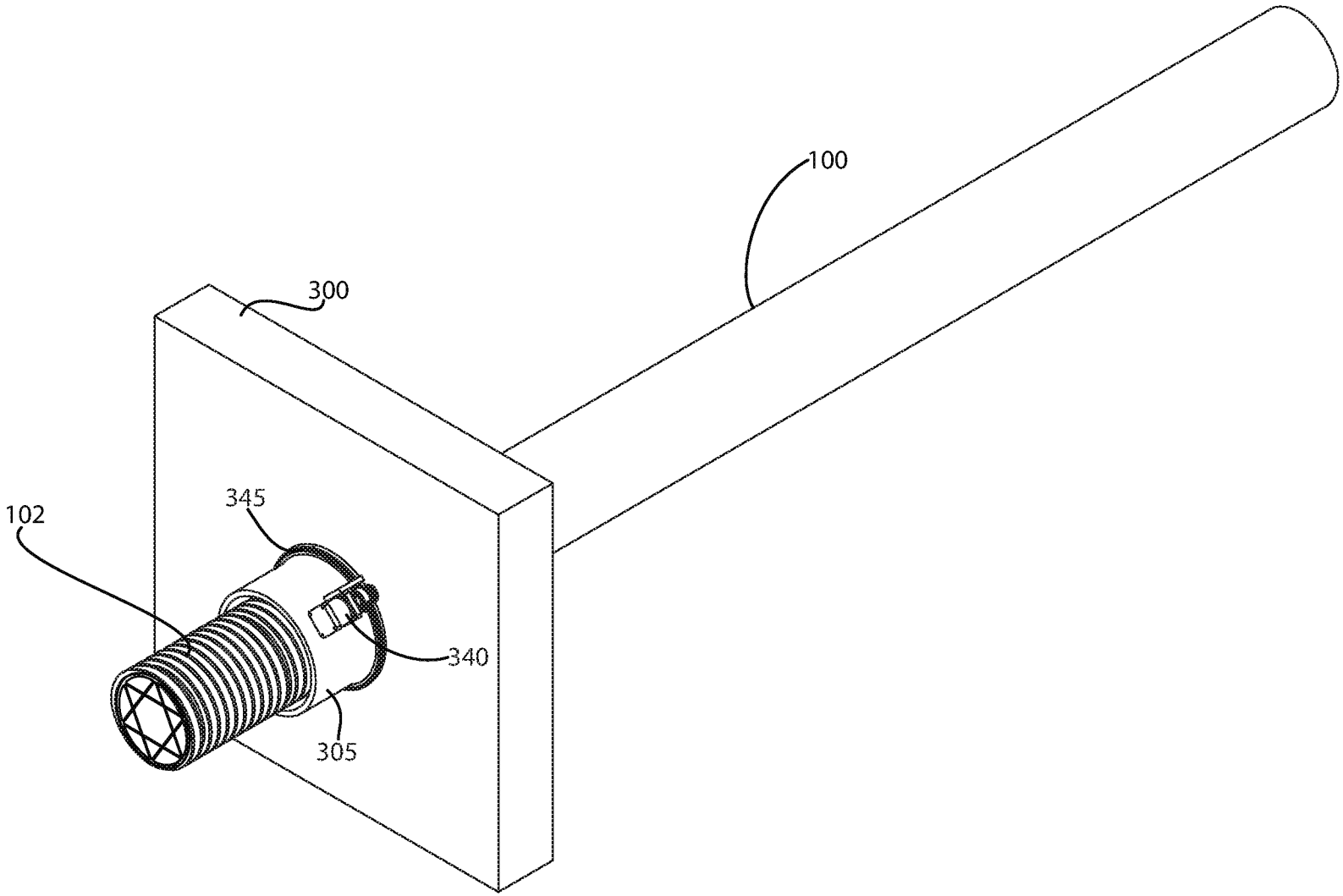
FIG. 6 is a second schematic view of an exemplary pile proceeding through a grooving machine, according to principles of the invention.

Referring to FIGS. 5 and 6, schematics conceptually illustrate a machine for forming grooves 102 in an extruded pile 100 according to principles of the invention. As discussed above, grooves 102 are formed in the bottom portion of the outer (and/or inner) surface of the pile. Such grooves 102 are cut into the pile 100 after extrusion. A machine includes a cutting motor 320 with a rotating cutting wheel 315 and an actuator 325 (linear actuator) with a pivoting support frame 330 that moves the cutting motor 320 and rotating cutting wheel 315 towards and away from the surface of the pile 100 to be grooved. The rotating cutting wheel 315 may be a dado blade. The depth of the groove is controlled by controlling the position of the cutting wheel 315. In an exemplary implementation, the grooves have a depth of approximately 5% to 25% of the total thickness of the outer wall of the pile. The cutting motor 320 is fixed to a portion of the pivoting support frame 330. The actuator 325, frame 330 and cutting motor 320 are mounted to a sleeve 305 that revolves around the extruded pile 100. The sleeve extends through a passage in a wall 300. A slip ring 310 supplies electric power to the actuator 325 and cutting motor 320. On the opposite side of the wall 300, a drive motor 340 with a drive gear drives a ring gear 335 attached to the sleeve 305. The drive motor 340, which is fixed to the wall 300 causes the sleeve to rotate (i.e., revolve around the pile 100) as the pile 100 passes through the sleeve 305.

In the exemplary implementation, the extruded pile 100 proceeds through the sleeve 305 in the direction shown by the dotted arrow line in FIG. 5. However, the machine may be configured for the pile 100 to proceed through the sleeve in the opposite direction.

The grooves 102 may comprise a continuous thread-like spiral groove, or separate spaced apart (e.g., parallel) grooves. The grooves 102 provide a rough surface that resists uplift when the bottom portion of the pile is embedded in the sea bed. Without the grooves 102, uplift could pose a serious problem for a smooth surfaced constant diameter pile. Optionally, for further frictional resistance to uplift, a similar machine with a wire wheel instead of a cutter 315 may be used to roughen the surface of the grooved portion 102 of the pile. Alternatively, the grooves 102 and roughening may be formed manually using hand tools.

In the exemplary implementation, the wall is stationary. Therefore, the formed groove is a thread-like groove that proceeds in a spiral pattern. The number of threads per unit length depend upon the rate of rotation of the sleeve 305 and the speed at which the pile advances from the extrusion die. Increasing the rate of rotation of the sleeve 305 increases the number of threads per unit length. Decreasing the rate of rotation of the sleeve 305 decreases the number of threads per unit length.

If spaced apart grooves are desired, the wall can be mounted on a track or sled that moves the wall linearly relative to the pile. As the cutter 315 makes a groove, the wall moves at the same speed and in the same direction of the cutter. Then the cutter 315 is positioned for the next groove, and the relative movement is repeated.

In FIGS. 5 and 6, the end of the pile 100 opposite the grooved end 102 is shown as a cut end. While the machine may be used with pre-cut piles, in a preferred implementation the machine is incorporated into the extrusion line, after the pile 100 emerges from the die and is cooled, and before the pile 100 is cut. The pile 100 is cut after the groove 102 is formed. Cutting may be accomplished at a station downstream from the grooving machine.

Figure 7:
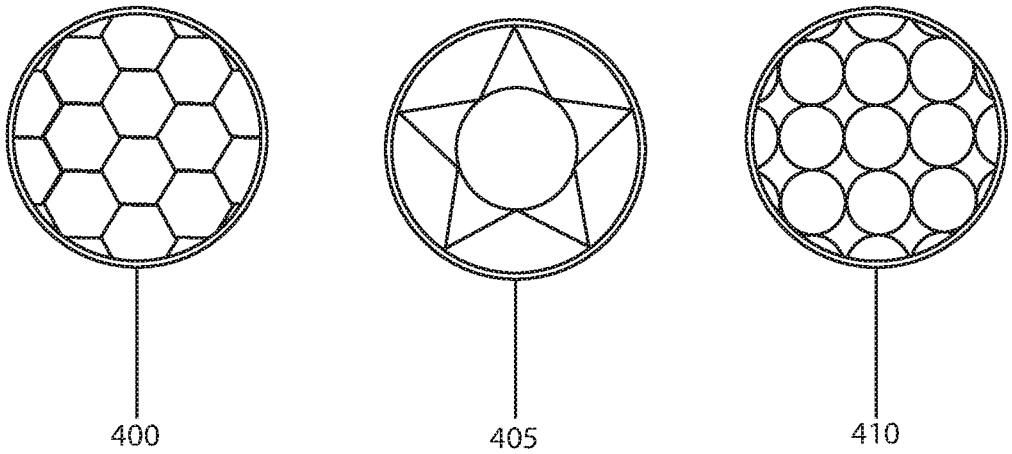
FIG. 7 provides plan views of non-limiting examples of alternative profiles for a pile according to principles of the invention.

Referring now to FIG. 7, nonlimiting examples of other profiles are provided. One profile includes a honeycomb pattern 400, another includes a star pattern with a concentric pipe 405, and another includes repeating pipes and pipe segments 410. Each of these profiles structurally reinforce the pile 100 by providing walls that extend internally from side to side. In each of the embodiments, converging pairs of walls intersect the interior side of the pipe at least once every 72° (e.g., as in the profile of 405). The converging pairs of walls act as trusses, stabilizing the structure and distributing forces.

The invention is not limited to the profiles of FIG. 7, or to the profile illustrated in FIG. 1. While the profile of FIG. 1 is preferred, any profile that includes a plurality of walls extending from side to opposite side of the interior space of the pile, with converging pairs of walls that intersect the interior side of the pipe at least every 72°, may be used. Such walls may be curved or planar. The patterns may be polygonal, non-polygonal, circular, elliptical or irregularly shaped.

Figure 8:
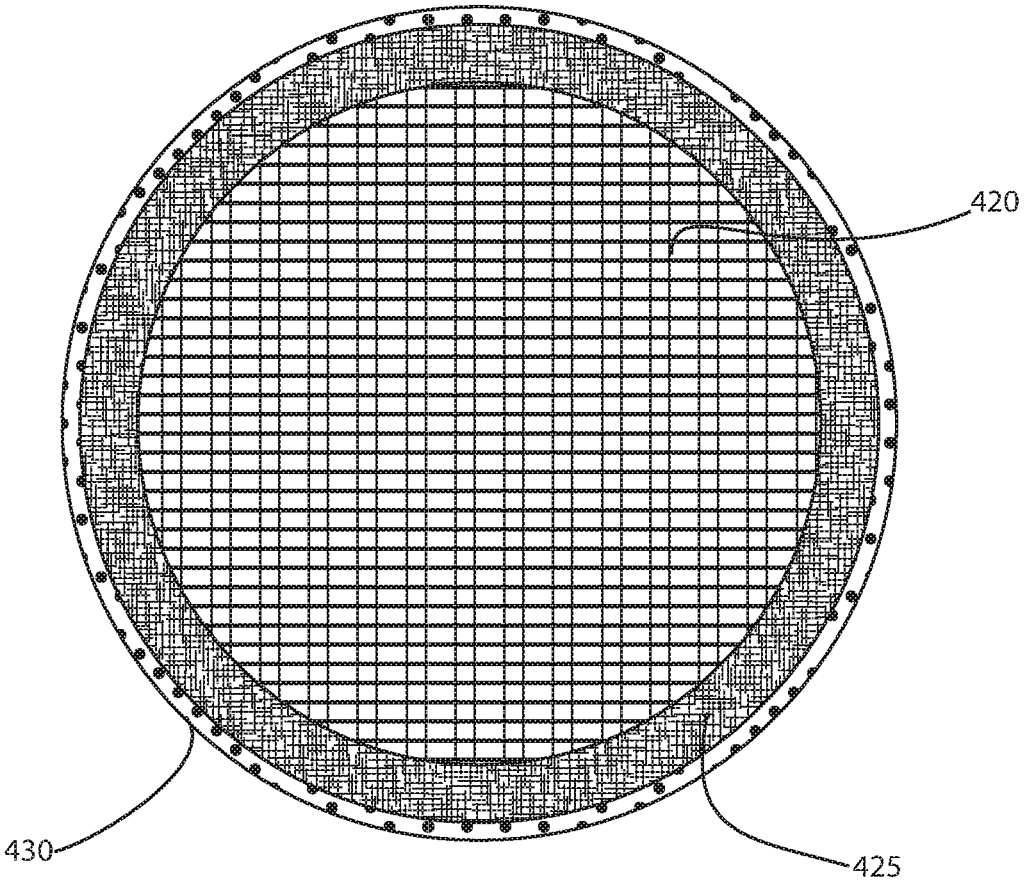
FIG. 8 provides a schematic conceptually illustrating layers of a pile according to principles of the invention.

FIG. 8 conceptually illustrates layers of a pile according to principles of the invention. The interior structure 420, conceptually represented with vertical and horizontal cross hatching, is occupied by a plurality of walls extending from side to opposite side of the interior space of the pile, with converging pairs of walls that intersect the interior side of the pipe at least every 72°, as described above. The pipe wall 425 is a solid wall in a tubular (hollow elongated cylinder) shape. The interior structure 420 and the pipe wall have the same composition. A cap-stock, outer layer 430, is applied on (coextruded over) the solid wall 425. Exemplary thicknesses and compositions of each portion is described above.

Figure 9:
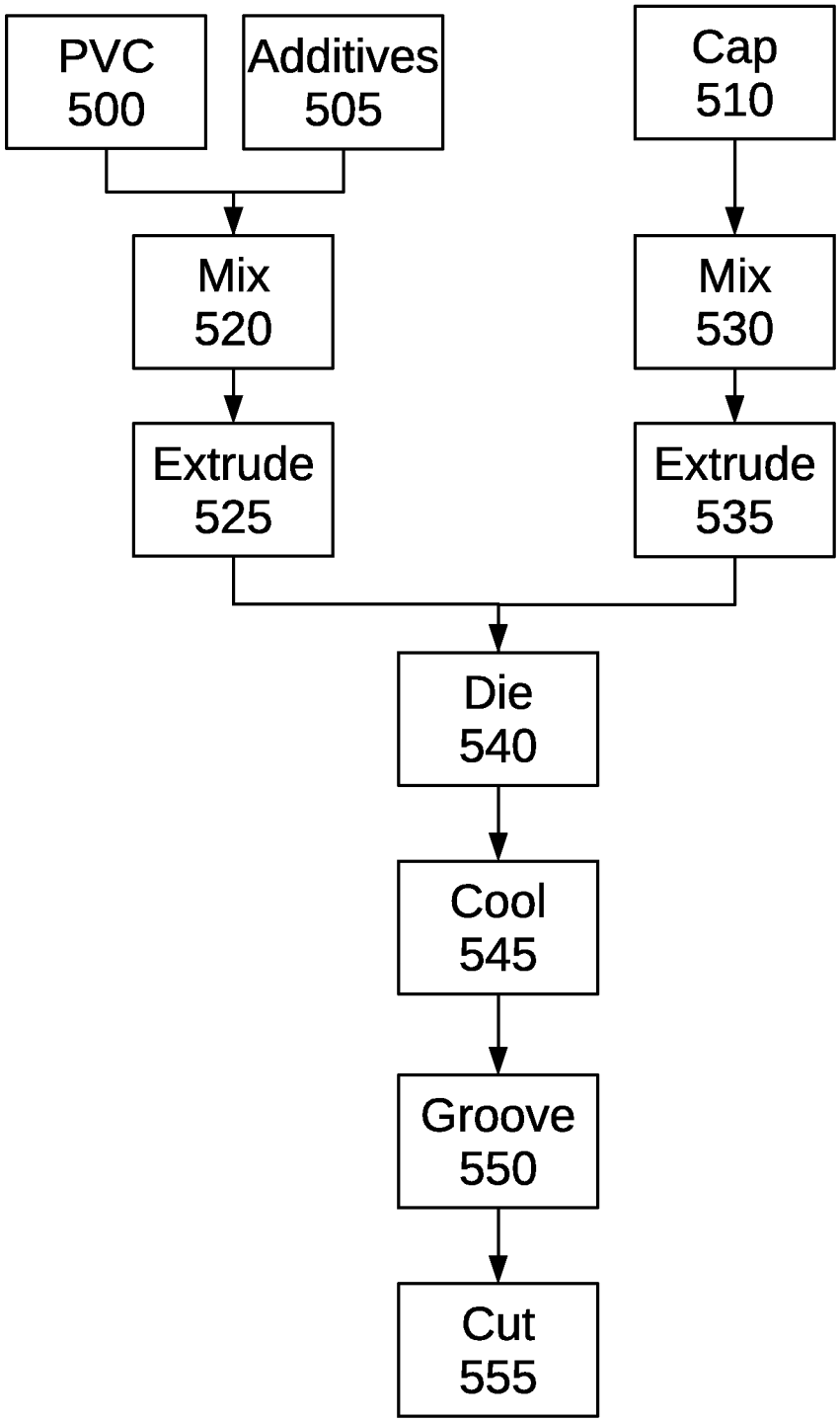
FIG. 9 is a high-level flowchart of steps of an exemplary method of producing a pile according to principles of the invention.

Referring to the high-level flowchart of FIG. 9, PVC 500, such as pellets, compound or recycled PVC, and additives 505, including glass fibers, are combined and blended in step 520. Alternatively, ingredients may be gravimetrically fed with different feeders directly above the extruder feed throat, assuming there are enough space and feeders to accommodate the various components in the formulation. Concomitantly, components for the cap stock 510 are blended in step 530. The blended components are introduced into their respective extruder, in steps 525 and 535. Such introduction may be accomplished by placing the preblended materials in a hopper over the feed throat, allowing gravity and the screw to feed the formulation to each extruder. After feeding, polymers are melted or plasticated, conveyed forward, and melt mixed in the extruder. Each extruder supplies the extrudate to an inlet to the die. The die shapes the extrudates into the desired cross section, as in step 540. The extruded material must then be cooled to its glass transition temperature ($T_g$) to retain its shape. Such cooling, as in step 545, may be accomplished with water, air, or contact with a cold surface. After cooling, a continuous spiral groove (or separate spaced apart grooves) may be cut into a portion of the extruded structure, as in step 550. Equipment and methods for cutting grooves are described above. After groove formation, a pile may be cut to length, as in step 555.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. An integrally formed extruded pile comprising:

an outer pipe having an exterior surface, an outer diameter of at least eight inches, and an annular cross-section shape defining an interior space, and having a length from a first end to an opposite second end; and a plurality of intersecting walls within the interior space, the intersecting walls being coextensive with the outer pipe, the intersecting walls forming a plurality of spaced apart vertices that intersect the outer pipe, and each wall of the plurality of intersecting walls being straight and defining a chord in the annular cross-section shape; and a groove formed in the exterior surface of the outer pipe adjacent to the first end, the groove being configured to frictionally resist uplift when a portion of the pile that includes the groove is embedded in earth; and the extruded pile being comprised of a blend of polyvinylchloride and chopped strand glass fibers.

2. The integrally formed extruded pile of claim 1, further comprising an outer layer formed by coextrusion, the outer layer comprising an infrared radiation inhibitor.

3. The integrally formed extruded pile of claim 2, the outer layer further comprising an impact modifier.

4. The integrally formed extruded pile of claim 1, the groove comprising a continuous spiral groove extending from the first end to a position along the length, the position being between a midpoint of the length and the first end.

5. The integrally formed extruded pile of claim 1, each vertex of the plurality of spaced apart vertices being equally spaced apart from another vertex of the plurality of spaced apart vertices.

6. The integrally formed extruded pile of claim 5, the plurality of spaced apart vertices comprising at least 5 spaced apart vertices.

7. The integrally formed extruded pile of claim 1, the intersecting walls forming a hexagram cross-section shape, the hexagram cross section shape including six vertices, each vertex of the six vertices intersecting the outer pipe;

and each vertex of the six vertices being evenly spaced apart from adjacent vertices, and each vertex being directly opposite another vertex.

8. The integrally formed extruded pile of claim 1, the outer pipe having a wall thickness of 0.25 to 0.50 inches.

9. The integrally formed extruded pile of claim 1, each wall of the plurality of intersecting walls within the interior space having a wall thickness of 0.125 to 0.25 inches.

10. The integrally formed extruded pile of claim 1, the outer diameter being about 12 inches.

11. An integrally formed extruded pile comprising:

an outer pipe having an exterior surface, an outer diameter of at least eight inches, an annular cross-section shape defining an interior space, and a length from a first end to an opposite second end; and a plurality of intersecting walls within the interior space, the intersecting walls being coextensive with the outer pipe, the intersecting walls forming a plurality of spaced apart vertices that intersect the outer pipe, and each wall of the plurality of intersecting walls being straight and defining a chord in the annular cross-section shape; and a groove cut into the exterior surface of the outer pipe adjacent to the first end, the groove being configured to frictionally resist uplift when a portion of the pile that includes the groove is embedded in earth; and the extruded pile being comprised of a blend of polyvinylchloride and chopped strand glass fibers having diameters of 5 to 18 μm and strand lengths of 0.125 to 0.50 inches, the glass fibers comprising 20 to 50% by weight of the blend; and the extruded pile further comprising an outer layer formed by coextrusion, the outer layer comprising an infrared radiation inhibitor.

12. The integrally formed extruded pile of claim 11, the infrared radiation inhibitor comprising one of titanium dioxide and zinc dioxide.

13. The integrally formed extruded pile of claim 12, the outer layer further comprising an impact modifier.

14. The integrally formed extruded pile of claim 11, the groove comprising a continuous spiral groove extending from the first end to a position along the length, the position being between a midpoint of the length and the first end.

15. The integrally formed extruded pile of claim 11, each vertex of the plurality of spaced apart vertices being equally spaced apart from another vertex of the plurality of spaced apart vertices.

16. The integrally formed extruded pile of claim 15, the plurality of spaced apart vertices comprising at least 5 spaced apart vertices.

17. The integrally formed extruded pile of claim 11, the intersecting walls forming a hexagram cross-section shape, the hexagram cross section shape including six vertices, each vertex of the six vertices intersecting the outer pipe; and each vertex of the six vertices being evenly spaced apart from adjacent vertices, and each vertex being directly opposite another vertex.

18. The integrally formed extruded pile of claim 11, the outer pipe having a wall thickness of 0.25 to 0.50 inches.

19. The integrally formed extruded pile of claim 11, each wall of the plurality of intersecting walls within the interior space having a wall thickness of 0.125 to 0.25 inches.

20. The integrally formed extruded pile of claim 11, the outer diameter being about 12 inches.

* * * * *